US006145948A

United States Patent [19]

Kishida

[11] Patent Number: 6,145,948

[45] **Date of Patent: *Nov. 14, 2000**

[54] INK JET HEAD AND INK JET RECORDING APPARATUS IN WHICH BOTH PRELIMINARY HEATING AND DRIVING SIGNALS ARE SUPPLIED ACCORDING TO STORED IMAGE DATA

[75] Inventor: Hideaki Kishida, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/249,928

[22] Filed: May 26, 1994

[30] Foreign Application Priority Data

May 26, 1993 [JP] Japan ..... 5-124193

[51] Int. Cl.[7] ..... B41J 29/38

[52] U.S. Cl. ..... 347/13; 347/14; 347/17; 347/60

[58] Field of Search ..... 347/17, 60, 14, 347/12, 13, 10, 11

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/9 |
| 4,558,333 | 12/1985 | Sugitani et al. | 347/65 |
| 4,560,993 | 12/1985 | Hakoyama | 346/76 PH |
| 4,723,129 | 2/1988 | Endo et al. | 347/56 |
| 4,740,796 | 4/1988 | Endo et al. | 347/56 |
| 4,791,435 | 12/1988 | Smith et al. | 346/140 R |
| 4,804,976 | 2/1989 | Ohmori et al. | 346/76 PH |
| 5,107,276 | 4/1992 | Kneezel et al. | 347/14 |
| 5,168,284 | 12/1992 | Yeung | 347/17 |
| 5,172,134 | 12/1992 | Kishida et al. | 347/10 |
| 5,281,980 | 1/1994 | Kishida et al. | 347/13 |
| 5,353,051 | 10/1994 | Katayama et al. | 347/13 |

FOREIGN PATENT DOCUMENTS

| | | | |
|---|---|---|---|
| 58-187364 | 11/1983 | Japan . | |
| 59-105967 | 6/1984 | Japan . | |
| 59-123670 | 7/1984 | Japan . | |
| 59-138461 | 8/1984 | Japan . | |
| 4-363251 | 12/1992 | Japan | 347/60 |
| 2218380 | 11/1989 | United Kingdom . | |

*Primary Examiner*—John Barlow
*Assistant Examiner*—Craig A. Hallacher
*Attorney, Agent, or Firm*—Fitzpatrick, Cella, Harper & Scinto

[57] ABSTRACT

An ink jet printer having an ink jet head is disclosed. The ink jet head includes a plurality of electrothermal transducers for producing thermal energy used to eject ink from the ink jet head. The ink jet printer has a storing device which stores image data used to drive the electrothermal transducers and a switching device which switches energization periods for the electrothermal transducers in accordance with the image data stored in the storing device. The printer operates so that during a recording operation, when an image datum stored in the storing device instructs recording, the switching device supplies a first drive signal for preliminary ink heating and a second drive signal for ejecting the ink. When the image datum stored in the storing device is datum not instructing recording, the switching device supplies the first drive signal and does not supply the second drive signal.

25 Claims, 10 Drawing Sheets

INK JET HEAD AND INK JET RECORDING APPARATUS IN WHICH BOTH PRELIMINARY HEATING AND DRIVING SIGNALS ARE SUPPLIED ACCORDING TO STORED IMAGE DATA

FIELD OF THE INVENTION AND RELATED ART

The present invention relates to an ink jet recording head for ejecting ink droplet through an ejection outlet or ejection outlets using thermal energy and an ink jet recording apparatus using the ink jet recording head.

In an ink jet recording apparatus, droplets of ink is formed through one of various processes, and the droplets are deposited on a recording material such as recording paper or the like to effect the recording. Among the various processes, an ink jet recording process using thermal energy for the droplet formation is advantageous in that multi-nozzle structure at high density can be easily accomplished, and therefore, high resolution and high quality image can be provided at high speed.

In a type of ink jet recording apparatus, a recording head is used in which a plurality of droplet formation means for ejecting ink droplets through ejection outlets by thermal energy applied to the ink, that is, the droplet formation means having electrothermal transducer element for heating the ink by being supplied with current pulses, and integration circuit (driver IC) for driving the electrothermal transducers, are formed on a common substrate.

Referring to FIG. 8, there is shown an example of such an ink jet recording head and a driver. FIG. 9 illustrates drive timing therefor. In FIG. 8, designated by a reference numeral 2 are electrothermal transducers corresponding to ink ejection outlets 13 (not shown). The same number of record data (SI) as the number of the electrothermal transducer 2, are sequentially transferred in synchronism with data transfer clock (CLK) into shift registers 4 in the driver IC3 by an image data generating circuit 22, as shown in FIG. 9. The record data thus transferred are read in a latch circuit in accordance with input of latch signals (LAT). Thereafter, in accordance with divided drive signals (EI) and divided drive signal transfer clock (CEK), the driver IC3 is sequentially rendered active in response to flip-flop (F/F) 6. The electrothermal transducers 2 for which the record data signals for the driver IC3 are on, are selectively energized in the order shown in FIG. 9, only during on-state of the pulse width setting signal (END), by which the ink is ejected through the associated ejection outlets 13.

In such an apparatus, a bubble is created in the ink in response to energization of the electrothermal transducer element, and the pressure produced by the bubble creation is used to eject the ink from the recording head to effect the recording. Therefore, it is desired that the ink is maintained stably in an ejectable state. For this purpose, a particular consideration is paid, which is peculiar to this type of the apparatus.

More particularly, the ink exists in the nozzles of the recording head even when the recording operation is not carried out, and therefore, some measure is taken against property change such as viscosity increase due to drying or evaporation of the ink in the nozzle. For this purpose, it is known that the orifices of the recording head are covered with a cap when the recording operation is not carried out to prevent the drying or evaporation of the ink, using capping means. However, in the case of low humidity condition or long term rest, the viscosity increase of the ink is unavoidable if only such a dry preventing means is used. Accordingly, the use has been made, in addition to the capping means, with a recovery mechanism by which the air in the cap covering the recording head is sucked to suck the ink out from the nozzle, or a pump or the like is used to apply pressure into the nozzle to forcedly eject the ink having the changed property, or idle ejection operations are carried out toward a portion outside the recording sheet to discharge the high viscosity ink in the nozzle.

The recovery mechanism is usually automatically driven upon actuation of the main switch and so on. During the recording operation, it is desirable that it is operated at as long as possible intervals from the standpoint of reducing the ink consumption. Against the ink property change due to non-use of the nozzle during the recording operation, the recording operation is frequently stopped at short intervals to carry out the ejection recovery operation. This decreases the overall recording speed.

Particularly in the case of an ink jet recording apparatus having a multi-orifice recording head in which a great number of orifices are arranged in a line, some ejection outlets are hardly actuated because of the statistics of the record data. With such ejection outlets, the ejection intervals are very long. Thus, the nozzle actuation frequency is not uniform over the nozzles. The ink in the liquid passage with which the actuation rate is small, or the actuation intervals are long, is subjected to viscosity increase by drying, depending on the ambient condition such as humidity or temperature. Therefore, the ink ejection is not stabilized even to such an extent of failure of ink ejection.

Japanese Laid-Open Patent Application Nos. 187364/1983 and 105967/1984 disclose that the electrothermal transducers are supplied with electric energy not enough to eject the ink even when the ejection signals therefor are not applied, so that the ink temperature is maintained within a predetermined range to provide satisfactory ejection against increase of the viscosity of the ink under the low temperature conditions or the like (preliminary heating). If this system is used, the apparatus becomes bulky in the case of an ink jet recording head having a relatively large number of ejection outlets with the driving elements shown in FIG. 8.

SUMMARY OF THE INVENTION

Accordingly, it is a principal object of the present invention to provide an improved ink jet recording head and a recording apparatus using the same.

It is another object of the present invention to provide an ink jet recording head, and an ink jet recording apparatus using same wherein temperature non-uniformity in the recording head is reduced to permit stabilized ink ejection, with simple structure.

It is another object of the present invention to provide an ink jet recording head and an ink jet recording apparatus using the same in which an effective preliminary heating is carried out with a relatively simple structure so that the temperature variation attributable to non-uniform driving of the ejection drive, so that the frequency of the recovery operations by the recovery mechanism is significantly reduced, thus permitting high speed recording with stabilized quality.

According to an aspect of the present invention, there is provided an ink jet head comprising: a plurality of electrothermal transducers for producing thermal energy contributable to ink ejection; storing means for storing image data for the electrothermal transducers; switching means for switching energization periods for the electrothermal transducers in accordance with the image data stored in the storing means; wherein during recording operation using the electrothermal transducers, when an image datum stored in the storing means is a first datum instructing recording, the switching means supplies to the corresponding electrothermal transducer a first drive signal for preliminary ink heating and a second drive signal for ejecting the ink, and when the image datum is a second datum not instructing recording, the switching means supplies the first drive signal to the corresponding electrothermal transducer element and does not supply the second drive signal.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described in detail.

Figure 4:
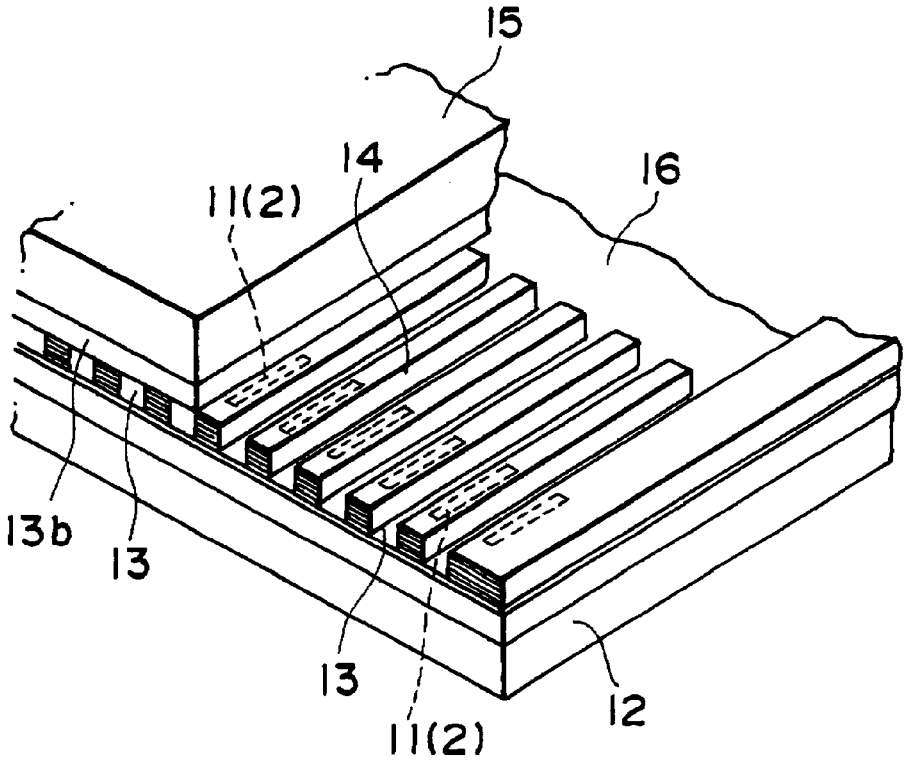
FIG. 4 illustrates an ink jet recording head applicable to the present invention.

Referring to FIG. 4, there is shown an ink jet recording head to which the present invention is applicable of a full-multi-type in which the ejection outlets are arranged over the entire width of a recording material. Designated by reference numeral 11 are heat generating register constituting electrothermal transducers 2 to eject the ink by creation of bubbles in the ink using film boiling. They are formed together with wiring on a substrate 12 through a manufacturing step which is similar to a semiconductor device manufacturing step. Designated by a reference 13A is a liquid passage forming member for forming ejection outlets 13 corresponding to the heat generating register 11 and liquid passages 14 respectively in communication therewith; 15 is a top plate. A common liquid chamber 16 is in communication with the liquid passages 14 and store the ink supplied from an unshown ink supply source.

Figure 1:
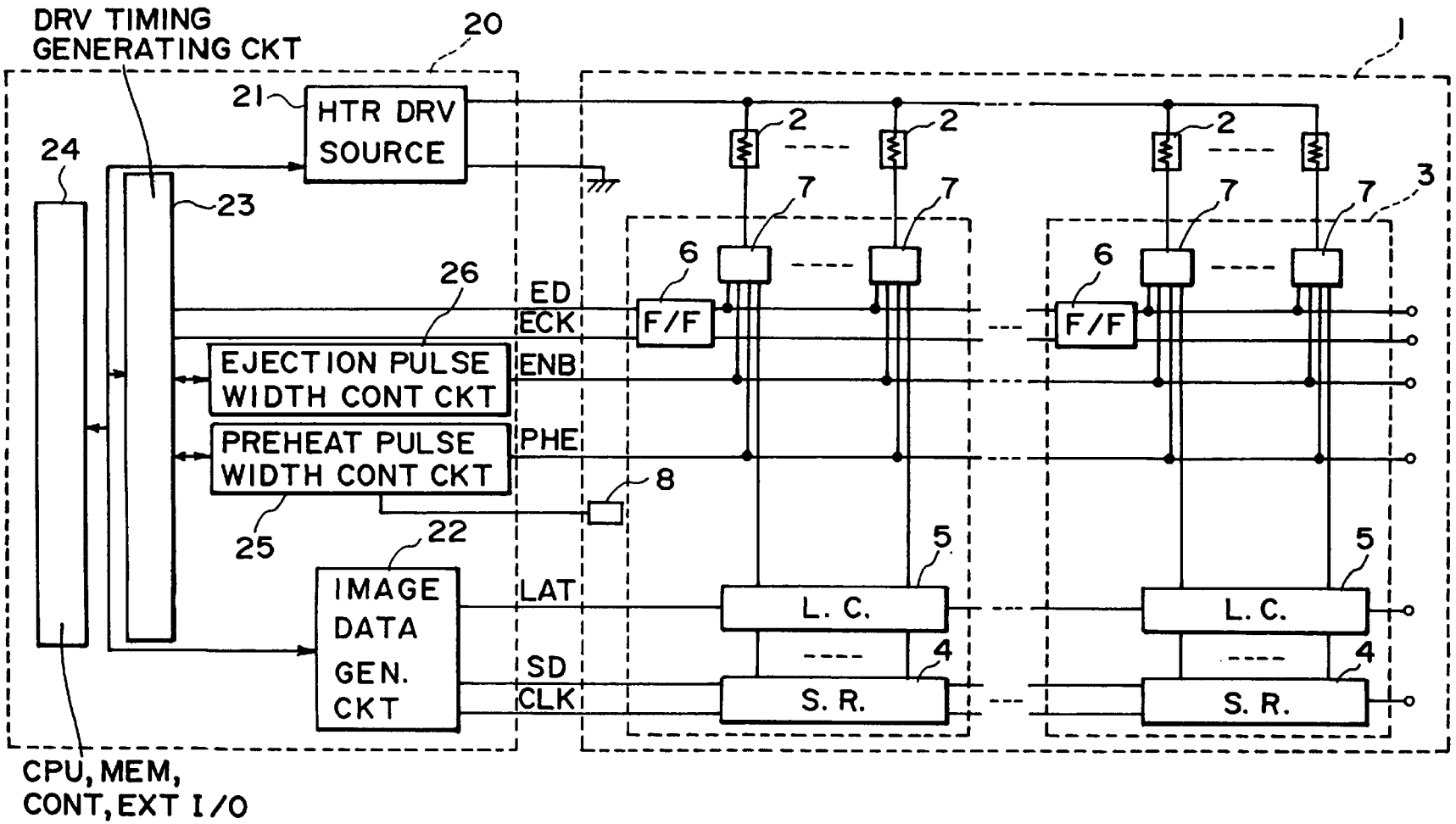
FIG. 1 is a block diagram of a circuit structure according to a first embodiment of the present invention.
Figure 8:
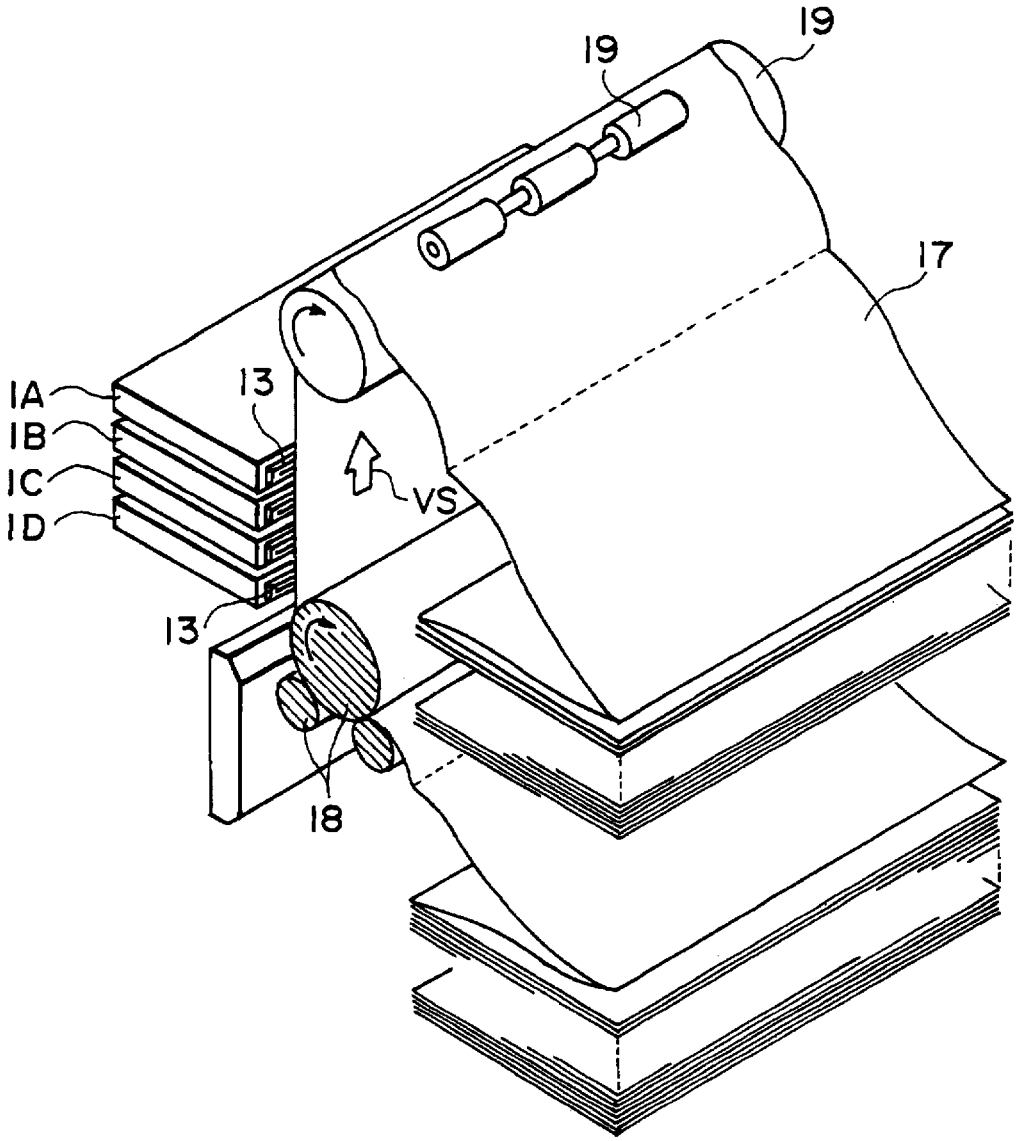
FIG. 8 is a perspective view of an ink jet recording head to which the present invention is applicable.
Figure 9:
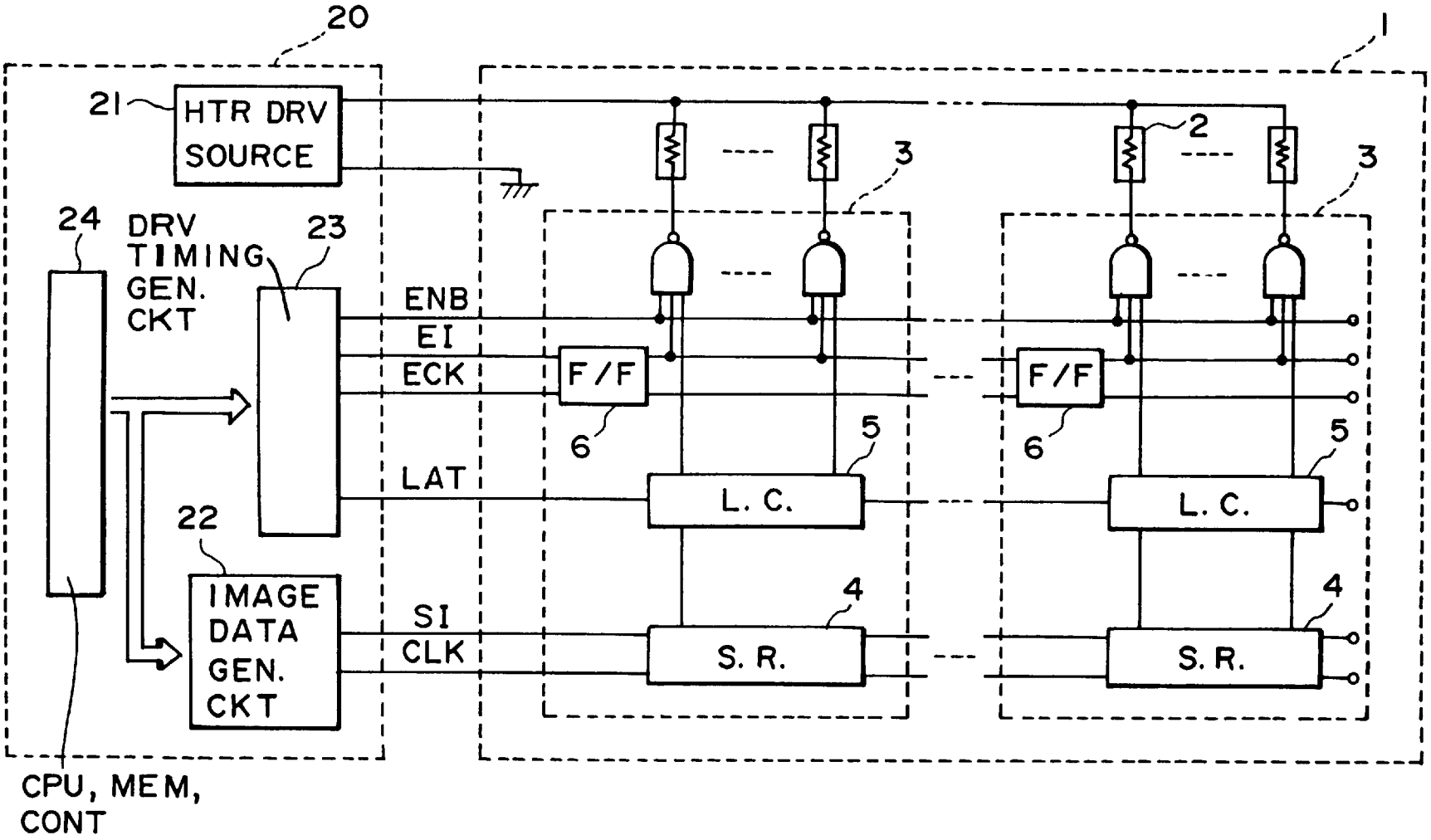
FIG. 9 is a block diagram of a circuit structure of a conventional ink jet recording apparatus.

FIG. 1 is a block diagram of an example of a circuit for the ink jet recording head having the above-described mechanical structure, according to an embodiment of the present invention. The same reference numerals as in FIG. 8 are assigned to the elements having the corresponding functions.

As shown in FIG. 1, a driving elements on the recording head 1 comprises a shift register 4 for receiving image data SD, a latch circuit 5 for temporarily storing the image data in response to latch signals LAT after reception of the image data, a flip-flop circuit 6 to permit sequential energization of electrothermal transducer in response to energy supply instruction data ED and energy supply instruction data transfer clock ECK, and a gate circuit 7 for switching energization period for the electrothermal transducer in accordance with ejection drive pulse width control signal ENB for controlling energization period for ejection drive, supplied from ejection drive pulse width control circuit 26, preliminary heating pulse width control signal PHE for controlling energization period for preliminary heating drive, supplied from a preliminary heating pulse width control circuit 25, and an output of the latch circuit 5. They are integrated for adjacent plurality of bits.

A head drive control circuit 20 in a main assembly of the recording apparatus comprises a heater drive source 21, a drive timing generating circuit 23, a preliminary heating pulse generating circuit 25, an ejection drive pulse generating circuit 26 and an image data generating circuit 22 and so on.

Figure 2:
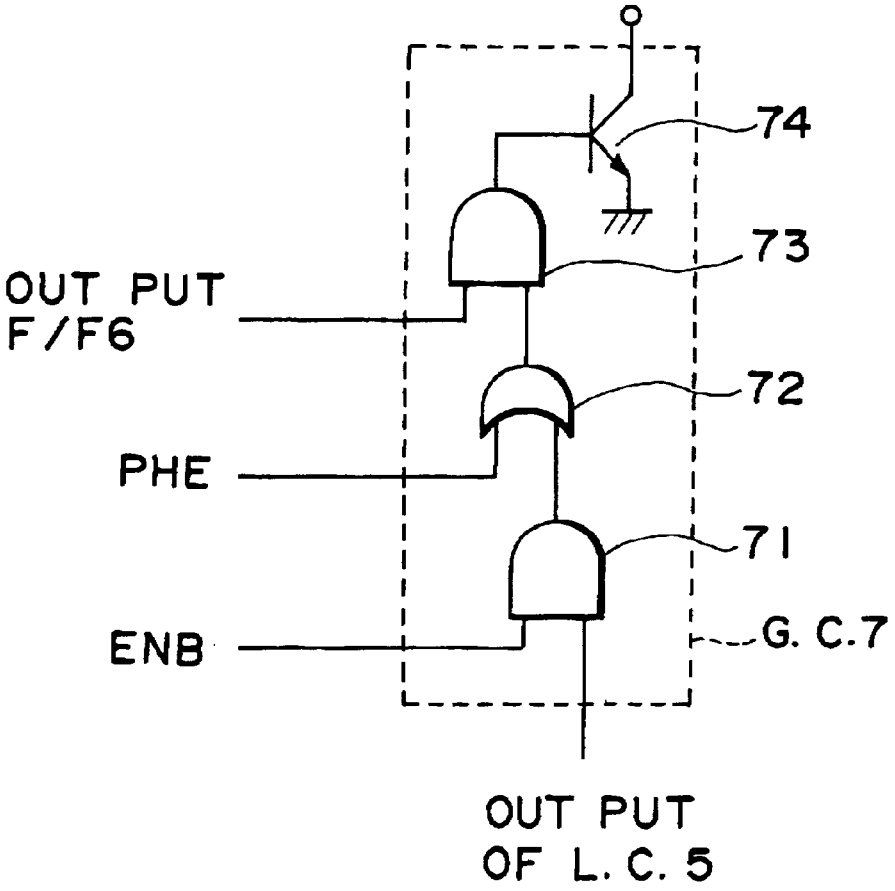
FIG. 2 is a block diagram showing details of a part of the circuit of FIG. 1.

The gate circuit 7, as shown in FIG. 2, for example, comprises a combination of AND-gates 71, 72, or OR-gate 72, a driver circuit 74 or the like.

When an output of the flip-flop F/F 6 is in on-state ("1"), and the preliminary heating pulse width control signal PHE is supplied to the OR-gate 72, the energy supply to the electrothermal transducer 2 is enabled while the PHE signal is on, when the ejection drive pulse width control signal ENB is supplied to the AND-gate, the output of the AND-gate 70 is "1" during on-state of the ENB signal only when the output of the latch circuit 5 is on, that is, the image data is "1", so as to enable energization of the electrothermal transducer 2 through the OR gate 72. When the output of the flip-flop F/F 6 is in the off-state, the energy supply to the electrothermal transducer 2 is disabled irrespective of the states of the other signals.

Figure 3:
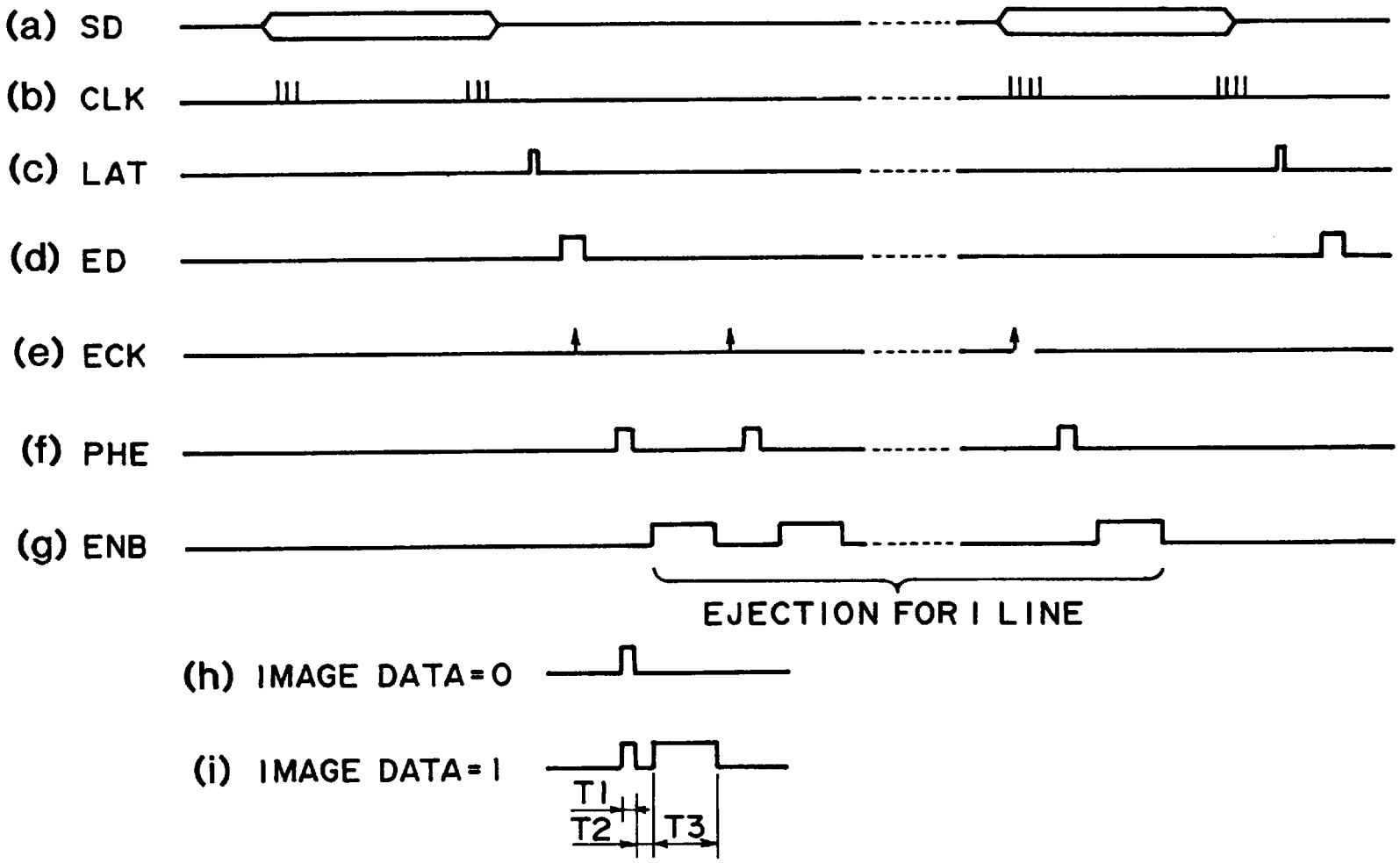
FIGS. 3*a–i* illustrate drive timing of the circuit sown in FIG. 1.

FIG. 3 illustrates drive timing in this embodiment. The image data SD for one line of record constituted by the same number of bits as the number of electrothermal transducers 2, are supplied to the shift register 4 in synchronism with the image data transfer clock CLK, and they are stored in the latch circuit 5 in accordance with the latch signal LAT. Subsequently, energization instruction data ED are supplied in synchronism with the energization instruction data transfer clock ECK to enable the energization of the electrothermal transducers 2 in the driver element. Then, the energy is supplied for the preliminary heating drive for all electrothermal transducers 2 in one block in response to the preliminary heating pulse width control signal PHE. Subsequently, in response to the ejection drive pulse control signal ENB, the energization for the ejection drive is effected for only the bits for which the image data are in on-state. In the energization of the electrothermal transducers 2, the preliminary heating drive and the ejection drive are carried out sequentially for each block for each production of the energization instruction data transfer block, in response to the image data SD and the energization instruction data ED. The operations are effected for all of the electrothermal transducers, so that ejection operations for one line are completed. During this operation, the image data for the next line is stored in a first shift register, and after completion of the ejection operations for one line, the ejection operations for the next line are immediately initiated.

The time period of the pulse width T1 of the preliminary heating pulse width control circuit PHE, the pulse width T3 of the ejection drive pulse width control signal ENB and the time period between the preliminary heating pulse and the ejection drive pulse, may be different depending on the individual recording heads, and further depending on ambient temperature or the recording head temperature. Therefore, in this embodiment, they are controllable by the preliminary heating pulse width control circuit 25 and the ejection drive pulse width control circuit 26 on the basis of temperature data from a temperature sensor 8 mounted in the recording head or adjacent thereto.

Figure 5:
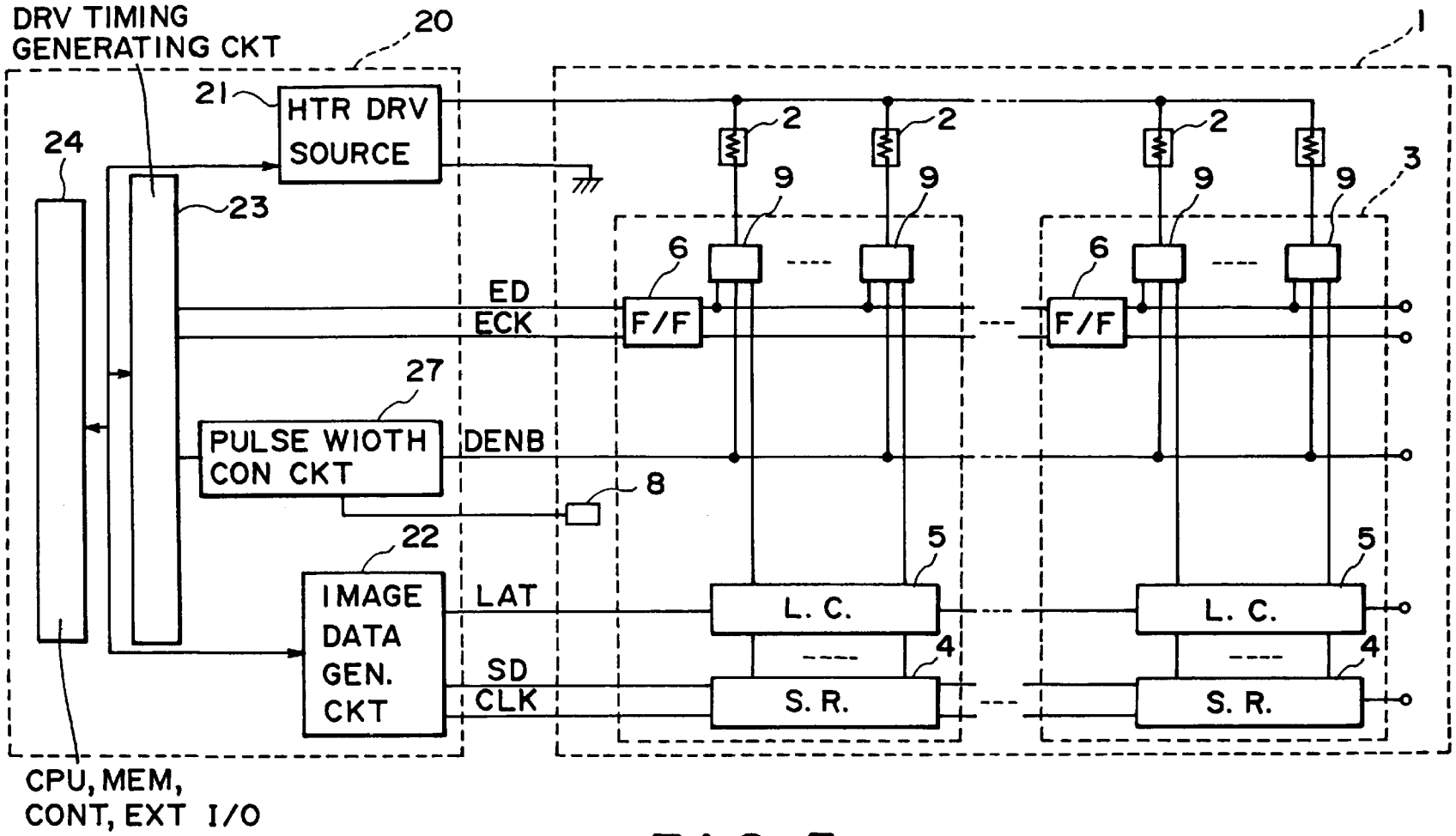
FIG. 5 is a block diagram of a circuit structure according to a second embodiment of the present invention.

FIG. 5 is a circuit block diagram according to another embodiment of the present invention.

The same reference numerals as in FIG. 1 are applied to the elements having the corresponding functions. In this embodiment, the preliminary heating pulse width control signal and the ejection drive pulse width control signal are commonly provided in the same signal double pulse drive control signal DENB, and the energization period of the electrothermal transducer element is switcheable depending on image data by energization period switching circuit 9 in the drive element.

The double pulse drive control signal DENB produced by a pulse width control circuit 27 repeats on-state and off-state alternately for the preliminary heating pulse and the ejection drive pulse, and are supplied to the recording head. The energization period switching circuit 9 enables the energization of the electrothermal transducer element 2 when the double pulse drive control signal DENG is on, under the condition that the output of the latch circuit 5 having received the image data is on, that is, the image data is "1", when the output of the flip-flop F/F 6 is on. Thus, the electrothermal transducer 3 is energized when the preliminary heating pulse is produced or when the ejection drive pulse is inputted. When the output of the latch circuit 5 is off, that is, when the image datum is "0", the energization period switching circuit 9 enabled energization of the electrothermal transducer 2 only when the preliminary heating pulse is already supplied, but the energization is prohibited for the next ejection drive pulse input.

Figure 6:
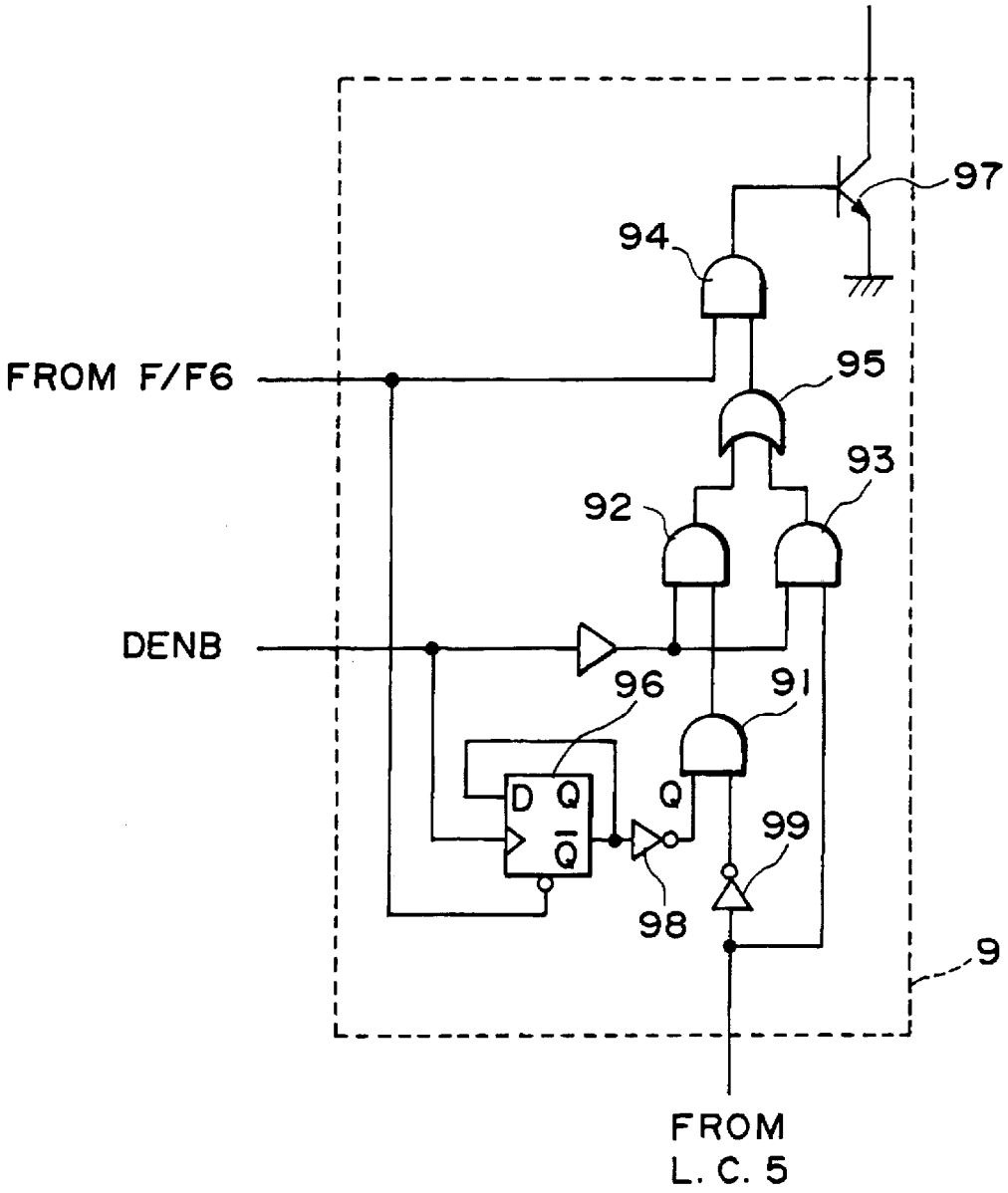
FIG. 6 is a block diagram showing details of a part of the circuit of FIG. 5.

FIG. 6 illustrates detailed structures of the energization period switching circuit 9, which comprises AND-gates 91–94, OR-gate 95, flip-flop 96 and a driver circuit 97 and so on.

The description will be made as to when the double pulse drive control signal DENB is produced when the output of the flip-flop F/F 6 is in the on-state ("1"). When the output of the latch circuit 5 is in the on-state, that is, when the image datum is "1", the driver circuit 97 is driven through the AND-gate 93, OR-gate 95 and the AND-gate 94, so that the electrothermal transducer 2 is energized during the period in which the preliminary heating pulse and the ejection drive pulse are on. When the output of the latch circuit 5 is off, that is, the image datum is "0", the driver circuit 97 is driven through the AND-gate 91, 92 and OR-gate 95 and AND-gate 94, so that the electrothermal transducer 2 is energized for an on-period of the preliminary pulse. Thus, in accordance with the output of the flip-flop F/F 6, the flip-flop 96 is recessed, and the reverse of the output $\overline{Q}$ is "1". When the double pulse drive control signal DENB is rendered on in response to the preliminary heating pulse in this state, the reverse output of the flip-flop 96 $\overline{Q}$ becomes "0". The output is inverted by an inverter 98, and then is supplied to one output of the AND-gate 91. To the other input of the AND-gate 91, the output of the latch circuit 5 is supplied after being inverted by the inverter 99. Therefore, when the output of the latch circuit 9 is off, the output of the AND-gate 91 is "1". In this manner, the output of the AND-gate 92 is "1" during on-period of the preliminary heating pulse. The output is supplied to the AND-gate 94 through the OR-gate 95, and the driver circuit 97 is driven by the output, so that the electrothermal transducer 2 is energized during on-period of the preliminary heating pulse.

Then, when the double pulse drive control signal DENB is rendered on in accordance with ejection drive pulse, the reverse output Q of the flip-flop 96 is rendered "1". Therefore, the output of the AND-gate 91 becomes "0", so that the electrothermal transducer 2 is not energized by the ejection drive pulse.

Figure 7:
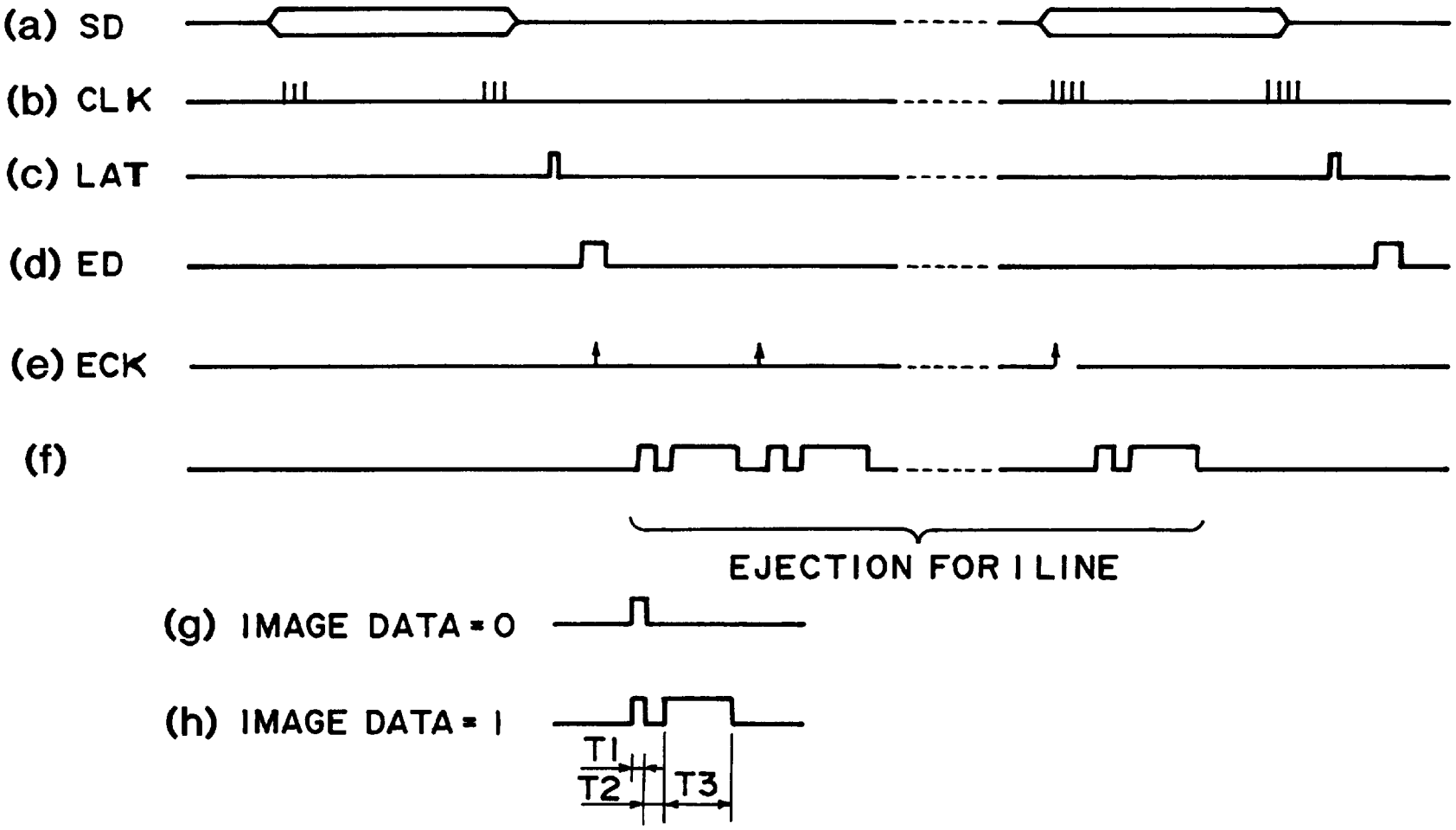
FIGS. 7*a–h* illustrate drive timing of the circuit of FIG. 5.

FIG. 7 illustrates drive timing in the embodiment of FIG. 5. The image data for one line are supplied to the shift register 4, and the image data are stored in the latch circuit 5 in response to the latch signal LAT. Then, energization instruction data ED are produced to enable energization of the electrothermal transducer elements 2 in the driving elements grouped into blocks. Subsequently, in response to the double pulse drive control signal DENB, only the preliminary heating drive is carried out for each of the bits having image data "0", and both of the preliminary heating drive and the ejection drive are carried out for the bits having the image data "1". The operations are carried out sequentially for all of the blocks of the electrothermal transducers 2, by which the ejection operation for one line is completed.

Thus, the number of contacts for the signals and the numbers of signal lines between driving elements, can be reduced, so that compact and low cost ink jet recording heads can be provided.

In FIGS. 1 and 5, a plurality of adjacent electrothermal transducers constitute one group, and they are integrated for each group. The driving element is provided for each blocks of the electrothermal transducers which are sequentially driven. Therefore, the control signals are connected in series. However, the present invention is applicable to the case that the driving element is divided into a plurality of blocks with the sequentially driven block unit are constituted at an interval of a plurality of bits or the case that the control signals supplied to the recording head are grouped into a plurality of blocks separately actuated.

Figure 10:
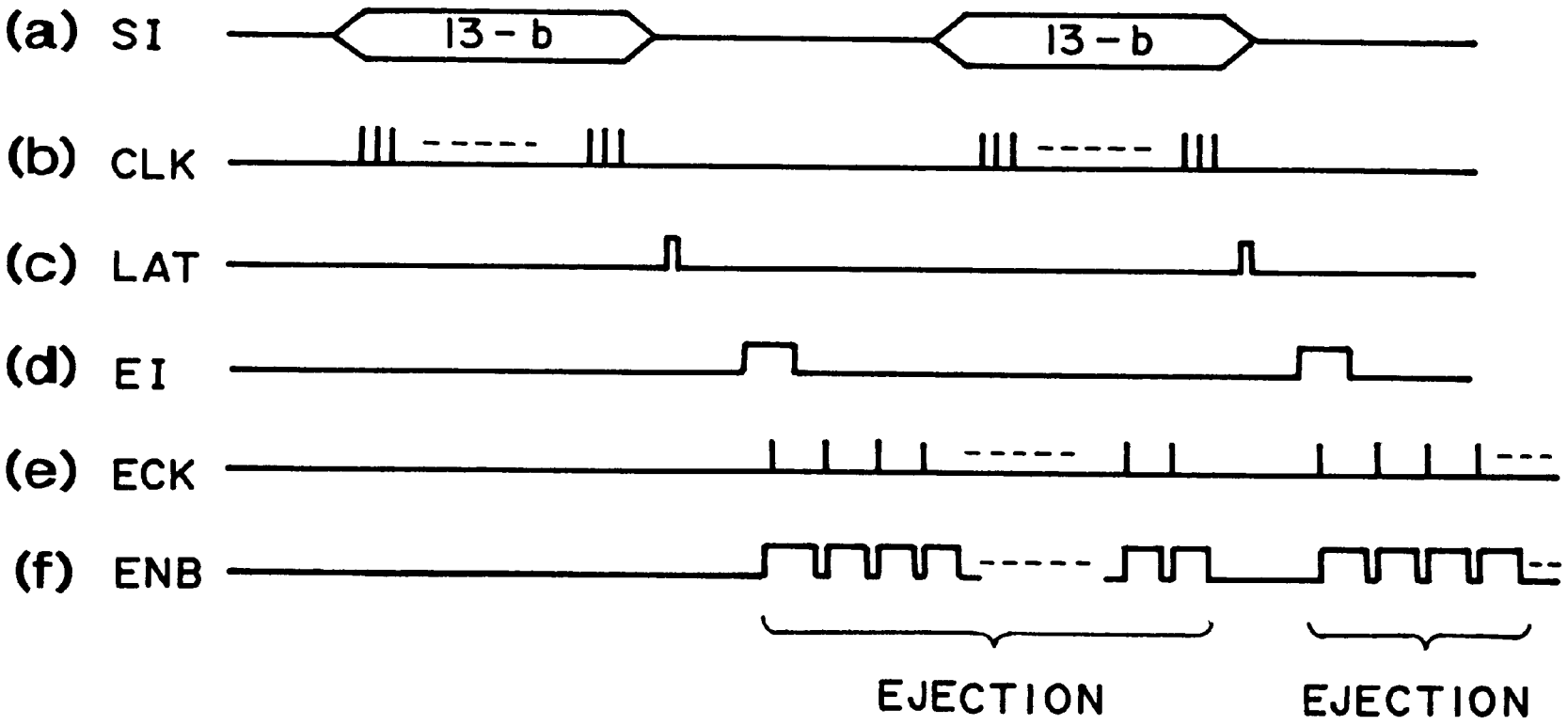
FIGS. 10*a–f* illustrate drive timing of the circuit of FIG. 9.

FIG. 10 shows an example of a multi-color ink jet recording apparatus in which a plurality of full-multi-type recording heads 1A, 1B, 1C and 1D using the above-described driving method, are disposed in parallel. The recording heads 1A, 1B, 1C and 1D eject cyan, magenta, yellow and black inks at predetermined timing through ejection outlet 13 onto the recording material 17. In accordance with feeding of the recording material in accordance with the above-described timing, the image is recorded or printed on the recording material 17. In this embodiment, the recording material 17 is a fan-fold sheet. Designated by reference numeral 18 is a sheet feeding roller; 19 is a discharging roller for cooperation with the feeding roller 18 to hold the recording material 17 at the recording position and for feeding it toward the discharge side in interrelation with the sheet feeding roller 18.

The present invention is usable with any ink jet apparatus, such as those using electromechanical converter such as piezoelectric element, but is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of he ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the effective preliminary heating drive of the electrothermal transducer is possible during recording operation with simple structure and with small number of signal lines. Thus, the temperature of the recording head is made uniform, and the stabilized ink ejection is possible with simple structure, and high quality recording is possible. In addition, the intervals between ejection operations can be made longer, thus increasing the recording speed.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head comprising:

a plurality of groups of a plurality of electrothermal transducers for producing thermal energy contributable to ejection of an ink;

storing means for storing image data for said electrothermal transducers;

selecting means for sequentially selecting groups from said groups of electrothermal transducers;

supply means for supplying a first drive signal or a second drive signal for the electrothermal transducers in the group selected by said selecting means in accordance with the image data stored in said storing means;

wherein the first drive signal comprises a first heat signal for preliminary ink heating and a second heat signal for ejecting the ink, and said second drive signal has the first heat signal and not the second heat signal;

wherein said supply means, during a recording operation, supplies the first heat signal to all of the thermal transducers in the selected group at a same timing irrespective of whether said second heat signal for ejecting the ink is supplied thereto.

2. An ink jet head according to claim 1, wherein said electrothermal transducer elements are grouped into a plurality of blocks, and are driven in time-shared manner for each block, and said storing means and said switching means are integrated for each unit, thus constituting a plurality of driving circuits.

3. An ink jet head according to claim 2, wherein the driving circuits are connected in series.

4. An ink jet head according to claim 1, further comprising temperature sensor for adjusting energization periods of said electrothermal transducer elements by at least one of the first signal and the second signal.

5. An ink jet recording apparatus comprising:

a recording head including a plurality of groups of a plurality of electrothermal transducers for producing thermal energy contributable to ejection of an ink;

storing means for storing image data for said electrothermal transducers; selecting means for sequentially selecting groups from said groups of electrothermal transducers; and first supply means for supplying a first drive signal or a second drive signal for said electrothermal transducers in the group selected by said selecting means in accordance with the image data stored in said storing means, wherein the first drive signal comprises a first heat signal for preliminary ink heating and a second heat signal for ejecting the ink, and said second drive signal has the first heat signal and not the second heat signal;

data transfer means for transferring the image data to said storing means;

second supply means for supplying to said first supply means a signal for producing the first drive signal or the second drive signal;

wherein said supply means, during a recording operation, supplies the first heat signal to all of the thermal transducers in the selected group at a same timing irrespective of whether said second heat signal for ejecting the ink is supplied thereto.

6. An apparatus according to claim 5, wherein said electrothermal transducer elements are grouped into a plurality of blocks, and are driven in time-shared manner for each block, and said storing means and said switching means are integrated for each unit, thus constituting a plurality of driving circuits.

7. An apparatus according to claim 6, wherein the driving circuits are connected in series.

8. An apparatus according to claim 5, further comprising temperature sensor for adjusting energization periods of said electrothermal transducer elements by at least one of the first signal and the second signal.

9. An apparatus according to claim 5, further comprising feeding means for feeding a recording material which is recorded upon by said recording head.

10. An apparatus according to claim 5, further comprising another recording head for effecting recording with a different color ink.

11. An apparatus according to any one of claims 5–10, wherein the electrothermal transducer elements are arranged over an entire width of a recording material which is recorded upon by said recording head.

12. A method of driving plurality of groups of a plurality of electrothermal transducers, comprising the steps of:

storing image data for said electrothermal transducers in storing means provided for the electrothermal transducers;

sequentially selecting groups from said groups of electrothermal transducers;

supplying, during a recording operation, a first drive signal and a second drive signal for the electrothermal transducers in the group selected in said selecting step in accordance with image data stored in the storing means;

wherein the first drive signal comprises a first heat signal for preliminary ink heating and a second heat signal for ejecting the ink, and said second drive signal has the first heat signal and not the second heat signal;

wherein said supplying step supplies the first heat signal to all of the thermal transducers in the selected group at a same timing irrespective of whether said second heat signal for ejecting the ink is supplied thereto.

13. A method according to claim 12, wherein said electrothermal transducers are grouped into a plurality of blocks, and are driven in a time-shared manner for each block.

14. A method according to claim 12, further comprising the step of adjusting energization periods of said electrothermal transducer elements by at least one of the first heat signal and the second heat signal in response to an output of a temperature sensor for sensing a temperature of said ink jet head.

15. An apparatus for driving a plurality of groups of a plurality of electrothermal transducers, comprising:

storing means for storing image data for said electrothermal transducers;

selecting means for sequentially selecting groups from said groups of electrothermal transducers;

supplying means for supplying, during recording operation, a first drive signal and a second drive signal for the electrothermal transducers in the group selected by said selecting means at a predetermined timing in accordance with image data stored in the storing means;

wherein the first drive signal comprises a first heat signal for preliminary ink heating and a second heat signal for ejecting the ink, and said second drive signal has the first heat signal and not the second heat signal;

wherein said supply means supplies the first heat signal to all of the thermal transducers in the selected group at a same timing irrespective of whether said second heat signal for ejecting the ink is supplied thereto.

16. An apparatus according to claim 15, wherein said electrothermal transducer elements are grouped into a plurality of blocks, and are driven in time-shared manner for each block, and said storing means and said supplying means are integrated for each unit, thus constituting a plurality of driving circuits.

17. An apparatus according to claim 16, wherein the driving circuits are connected in series.

18. An apparatus according to claim 15, further comprising a temperature sensor for adjusting energization periods of said electrothermal transducer elements by at least one of the first heat signal and the second heat signal.

19. An apparatus according to claim 15, further comprising feeding means for feeding a recording material which is recorded upon by said recording head.

20. An apparatus according to claim 15, further comprising another recording head for effecting recording with a different color ink.

21. An ink jet head comprising:

a plurality of groups of a plurality of electrothermal transducers for producing thermal energy contributable to ejection of an ink;

a memory circuit, provided for the plurality of electrothermal transducers, for storing image data;

selecting means for sequentially selecting groups from said groups of electrothermal transducers;

a supplying circuit responsive to said memory circuit to supply to said electrothermal transducers in the group selected by said selecting means a first drive signal having a first heat signal for preliminary heating of the ink and a second heat signal for ejecting the ink, or a second drive signal having the first heat signal and not having the second heat signal;

wherein said supply circuit, during a recording operation, supplies the first heat signal to all of the thermal transducers in the selected group at a same timing irrespective of whether said second heat signal for ejecting the ink is supplied thereto.

22. An ink jet head according to claim 21, wherein said electrothermal transducer elements are grouped into a plurality of blocks, and are driven in time-shared manner for each block, and said storing means and said switching means are integrated for each unit, thus constituting a plurality of driving circuits.

23. An ink jet head according to claim 22, wherein the driving circuits are connected in series.

24. An ink jet head according to claim 21, further comprising a temperature sensor for adjusting energization periods of said electrothermal transducer elements by at least one of the first heat signal and the second heat signal.

25. An ink jet head comprising:

a plurality of groups of a plurality of electrothermal transducers for producing thermal energy contributable to ejection of an ink;

storing means for storing image data for said electrothermal transducers;

selecting means for sequentially selecting groups from said groups of electrothermal transducers;

supply means for supplying a first drive signal or a second drive signal for the electrothermal transducers in the group selected by said selecting means in accordance with the image data stored in said storing means;

wherein the first drive signal comprises a first heat signal for preliminary ink heating and a second heat signal for ejecting the ink, supplied after a predetermined time interval from termination of supply of the first heat signal, and said second drive signal has the first heat signal and not the second heat signal;

wherein said supply means, during a recording operation, supplies the first heat signal to all of the thermal transducers in the selected group at a same timing irrespective of whether said second heat signal for ejecting the ink is supplied thereto.

* * * * *

UNITED STATES PATENT AND TRADEMARK OFFICE

CERTIFICATE OF CORRECTION

PATENT NO. : 6,145,948
DATED : November 14, 2000
INVENTOR(S) : Hideaki Kishida

It is certified that error appears in the above-identified patent and that said Letters Patent is hereby corrected as shown below:

Drawings:
Sheet 5 of 10, FIG. 5, "WIOTH" should read -- WIDTH --.

Column 1:
Line 10, "droplet" should read -- droplets --; and
Line 13, "is" should read -- are --.

Column 6:
Line 34, "blocks" should read -- block --.

Column 7:
Line 29, "he" should read -- the --; and
Line 66, "recording head mountable," should read -- mountable recording head, --.

Column 9:
Line 44, "plurality" (first occurrence) should read -- a plurality --

Signed and Sealed this

Thirteenth day of November, 2001

*Attest:*

Nicholas P. Godici

NICHOLAS P. GODICI
*Acting Director of the United States Patent and Trademark Office*

*Attesting Officer*